US006602403B1

(12) United States Patent
Steffens et al.

(10) Patent No.: US 6,602,403 B1
(45) **Date of Patent: *Aug. 5, 2003**

(54) PROCESS FOR SELECTIVELY PRODUCING HIGH OCTANE NAPHTHA

(75) Inventors: Todd R. Steffens, Randolph, NJ (US); Paul K. Ladwig, Randolph, NJ (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/437,161

(22) Filed: Nov. 10, 1999

Related U.S. Application Data

(63) Continuation-in-part of application No. 09/073,085, filed on May 5, 1998, now Pat. No. 6,069,287.

(51) Int. Cl.[7] ..... C10G 11/05

(52) U.S. Cl. ..... 208/120.01; 208/134; 208/135; 208/141

(58) Field of Search ..... 208/134, 135, 208/141, 120.01

(56) References Cited

U.S. PATENT DOCUMENTS

| | | | | |
|---|---|---|---|---|
| 3,442,792 | A | 5/1969 | Eng et al. | 208/62 |
| 3,533,937 | A | 10/1970 | Stankis | 208/62 |
| 3,770,618 | A | 11/1973 | Adams et al. | 208/216 |
| 3,801,494 | A | 4/1974 | Moore et al. | 208/79 |
| 3,893,905 | A | 7/1975 | Fenske et al. | 208/103 |
| 3,899,543 | A | 8/1975 | Cosyns et al. | 260/667 |
| 3,928,172 | A | 12/1975 | Davis, Jr. et al. | 208/77 |
| 3,957,625 | A | 5/1976 | Orkin | 208/211 |
| 3,959,116 | A | 5/1976 | Arey, Jr. et al. | 208/66 |
| 4,171,257 | A | 10/1979 | O'Rear et al. | 208/120 |
| 4,177,136 | A | 12/1979 | Herrington et al. | 208/215 |
| 4,282,085 | A | 8/1981 | O'Rear et al. | 208/120 |
| 4,502,945 | A | 3/1985 | Olbrich et al. | 208/120 |
| 4,830,728 | A | 5/1989 | Herbst et al. | 208/78 |
| 4,865,718 | A | 9/1989 | Herbst et al. | 208/70 |
| 4,927,526 | A | 5/1990 | Anderson et al. | 208/152 |
| 4,950,387 | A | 8/1990 | Harandi et al. | 208/49 |
| 4,975,179 | A | 12/1990 | Harandi et al. | 208/66 |
| 5,026,935 | A | 6/1991 | Leyshon et al. | 585/315 |
| 5,026,936 | A | 6/1991 | Leyshon et al. | 585/315 |
| 5,041,208 | A | 8/1991 | Patridge et al. | 208/138 |
| 5,043,522 | A | 8/1991 | Leysohn et al. | 585/651 |
| 5,047,142 | A | 9/1991 | Sherwood, Jr. et al. | 208/251 H |
| 5,069,776 | A | 12/1991 | Biswas et al. | 208/120 |
| 5,094,994 | A | 3/1992 | Sherwood, Jr. et al. | 502/314 |
| 5,143,596 | A | 9/1992 | Maxwell et al. | 208/89 |
| 5,160,424 | A | 11/1992 | Le et al. | 208/67 |
| 5,171,921 | A | 12/1992 | Gaffney et al. | 585/653 |
| 5,286,373 | A | 2/1994 | Sudhakar et al. | 208/216 |
| 5,292,976 | A | 3/1994 | Dessau et al. | 585/322 |
| 5,346,609 | A | 9/1994 | Fletcher et al. | 208/89 |
| 5,347,061 | A | 9/1994 | Harandi et al. | 585/323 |
| 5,348,928 | A | 9/1994 | Kukes et al. | 502/306 |
| 5,358,633 | A | 10/1994 | Dai et al. | 208/216 R |
| 5,372,704 | A | 12/1994 | Harandi et al. | 208/74 |
| 5,378,352 | A | 1/1995 | Degnan et al. | 208/217 |
| 5,389,232 | A | 2/1995 | Adewuyi et al. | 208/120 |
| 5,396,010 | A | 3/1995 | Harandi et al. | 585/418 |
| 5,409,596 | A | 4/1995 | Fletcher et al. | 208/89 |
| 5,414,172 | A | 5/1995 | Chin et al. | 585/322 |
| 5,468,372 | A | 11/1995 | Seamans et al. | 208/216 R |
| 5,472,594 | A | 12/1995 | Tsang et al. | 208/114 |
| 5,525,211 | A | 6/1996 | Sudhakar et al. | 208/217 |
| 5,576,256 | A | 11/1996 | Monque et al. | 502/61 |
| 5,591,324 | A | 1/1997 | Monque et al. | 208/216 R |
| 5,643,441 | A | 7/1997 | Timken et al. | 208/89 |
| 5,770,047 | A | 6/1998 | Salazar et al. | 208/254 R |
| 5,865,987 | A | 2/1999 | Borghard et al. | 208/97 |
| 5,865,988 | A | 2/1999 | Collins et al. | 208/97 |
| 5,951,963 | A | 9/1999 | He et al. | 423/713 |
| 5,985,136 | A | 11/1999 | Brignac et al. | 208/216 R |
| 5,997,728 | A | * 12/1999 | Adewuyi et al. | 208/120.01 |
| 6,126,812 | A | 10/2000 | Drake et al. | 208/134 |
| 6,126,814 | A | 10/2000 | Lapinski et al. | 208/217 |

FOREIGN PATENT DOCUMENTS

| | | | |
|---|---|---|---|
| EP | 0022883 A1 | 1/1981 | C10G/69/04 |
| EP | 0093475 A1 | 4/1982 | C10G/35/06 |
| EP | 0109060 A1 | 5/1984 | C07C/11/06 |
| EP | 0235416 A1 | 9/1987 | C10G/35/095 |
| EP | 0420326 A1 | 4/1991 | C10G/35/095 |
| EP | 0557527 A1 | 9/1993 | C10G/35/095 |
| EP | 0347003 B1 | 5/1996 | C10G/11/05 |
| EP | 0921179 A1 | 6/1999 | C10G/11/05 |
| EP | 0921181 A1 | 6/1999 | C10G/11/05 |
| WO | WO98/56874 | 12/1998 | C10G/11/00 |
| WO | WO 01/04237 | 1/2001 | C10G/11/00 |

OTHER PUBLICATIONS von Ballmoos et al., *Three–Dimensional Mapping of the Zoned Aluminum Distribution in ZSM–5,* Proceedings of the Sixth International Zeolite Conference, Reno, NV, Jul. 10–15, 1983, published by Butterworths & Co., Guilford, Engl., pp. 803–811, (1984)—No month.

*Journal of Catalysis,* vol. 71, pp. 447–448, (1981)—No month.

Derouane et al., *Applied Catalysis,* vol. 1, pp. 201–224, (1981) —No month.

(List continued on next page.)

*Primary Examiner*—Nadine G. Norton
(74) *Attorney, Agent, or Firm*—James A. Zhoray; Lucinda Lomas; Gerard J. Hughes

(57) ABSTRACT

This invention is related to a catalytically cracked or thermally cracked naphtha stream. The naphtha stream is contacted with a catalyst containing from about 10 to 50 wt. % of a crystalline zeolite having an average pore diameter less than about 0.7 nanometers at reaction conditions which include temperatures from about 500° C. to about 650° C. and a hydrocarbon partial pressure from about 10 to 40 psia. The resulting product is a high octane naphtha.

12 Claims, 5 Drawing Sheets

OTHER PUBLICATIONS

Jacobs et al., *J. Phys. Chem.,* vol. 86, pp. 3050–3052 (1982) —No month.

Fleisch et al., *Journal of Catalysis,* vol. 99, pp. 117–125 (1986)—No month.

Meyers et al., *Journal of Catalysis,* vol. 110, pp. 82–95 (1988)—No month.

Gross et al., *Surface composition of dealuminated Y zeolites studied by X–ray photoelectron spectroscopy* (Mar. 8, 1983)—No month.

Kung, *Stud. Surf. Sci. Catal.,* vol. 122, pp. 23–33, (1999)—No month.

* cited by examiner

PROCESS FOR SELECTIVELY PRODUCING HIGH OCTANE NAPHTHA

CROSS-REFERENCE TO RELATED APPLICATION

This is a continuation-in-part of U.S. Ser. No. 09/073,085 filed May 5, 1998 now U.S. Pat. No. 6,069,287.

BACKGROUND OF THE DISCLOSURE

1. Field of the Invention

The invention relates to a process for modifying a hydrocarbon mixture that contains olefins. More particularly, the invention relates to using a shape-selective molecular sieve catalyst in a catalytic cracking unit having such a hydrocarbon mixture as a feed. The catalytic cracking unit is operated under conditions that result in products with a diminished concentration of sulfur-containing species and an augmented concentration of saturated species compared to the feed.

2. Background of the Invention

The need for low emissions fuels has created an increased demand for high-octane motor gasoline blend-stocks having an increased concentration of saturated species and a reduced concentration of sulfur-containing species. Moreover, a low cost supply of light olefins; particularly propylene, continues to be in demand to serve as feedstock for polyolefin, particularly polypropylene production.

In this regard, conventional fluid catalytic cracking ("FCC") units may be operated to maximize olefin production to meet motor gasoline blending requirements. The operation of the unit is designed so that a suitable catalyst will act to convert a heavy gas oil to maximize either gasoline or light olefin production. Increasing production of the desired product may be achieved, for example, by using an optimal catalyst and by optimizing reaction parameters.

In yet another conventional process, a hydrocarbonaceous feedstock is converted by contacting the feedstock with a moving bed of a zeolitic catalyst comprising a zeolite with a pore diameter of 0.3 to 0.7 nm, at a temperature above about 500° C. and at a residence time less than about 10 seconds. Olefins are produced with relatively little saturated gaseous hydrocarbons being formed. In a related process, olefins are formed from hydrocarbonaceous feedstock in the presence of a ZSM-5 catalyst.

The conventional processes may not meet current or proposed motor gasoline concentration limits for sulfur species or for olefin having molecular weight above about $C_5$. Some conventional processes attempt to reduce sulfur and olefin concentration by employing a hydroprocessing stage subsequent to catalytic cracking. But such hydroprocessing may result in an undesirable reduction in naphtha octane number.

Therefore, there is a need for processes for forming naphthas such as high-octane motor gasoline blend-stocks having an increased concentration of saturated species.

SUMMARY OF THE INVENTION

In accordance with the present invention there is provided a process for forming a high-octane naphtha comprising: contacting a naphtha feed having a feed Reid Vapor Pressure ("RVP") and an average feed octane number and containing paraffinic species, sulfur-containing species, and olefinic species under catalytic conversion conditions with a catalytically effective amount of a catalyst containing 10 to 50 wt. % of a molecular sieve having an average pore diameter less than about 0.7 nm at a temperature ranging from about 500° C. to about 650° C., a hydrocarbon partial pressure ranging from about 10 to about 40 psia, a hydrocarbon residence time ranging from about 1 to about 10 seconds, and a catalyst to feed weight ratio ranging from about 2 to about 10 in order to form the high octane naphtha.

In another embodiment, the invention is a product formed in accordance with such a process.

In a preferred embodiment, no more than about 20 wt. % of the feed paraffinic species are converted to species in the high octane naphtha having molecular weights lower than about $C_4$; the high octane naphtha has about 60 wt. % to about 90 wt. % less olefin; and the high octane naphtha has an average product octane number ((R+M)/2) substantially the same as or greater than the feed's average octane number, and a product RVP substantially the same as or less than the feed RVP.

In another preferred embodiment, the catalyst contains about 10 wt. % to about 80 wt. % of a crystalline zeolite having an average pore diameter less than about 0.7 nm.

In another embodiment, the invention is a method for forming a high octane, low-sulfur blended gasoline, the method comprising:

(a) contacting a naphtha feed containing sulfur-bearing species and olefin under catalytic conversion conditions with a catalytically effective amount of a catalyst, wherein the catalyst contains 10 to 50 wt. % of a molecular sieve having an average pore diameter less than about 0.7 nm, at a temperature ranging from about 500° C. to about 650° C., a hydrocarbon partial pressure ranging from about 10 to about 40 psia, a hydrocarbon residence time ranging from about 1 to about 10 seconds, and a catalyst to feed weight ratio ranging from about 2 to about 10 in order to form a high octane naphtha, and then (b) combining at least a portion of the high octane naphtha with a gasoline having an initial RVP and an initial average octane number in order to form a blended gasoline having an average blend octane number substantially the same as or greater than the initial average octane number, and an average blend RVP substantially the same as or less than the initial RVP.

In yet another embodiment, the invention is a blended gasoline formed in accordance with such a process.

DETAILED DESCRIPTION OF THE INVENTION

Figures 1, 1A:
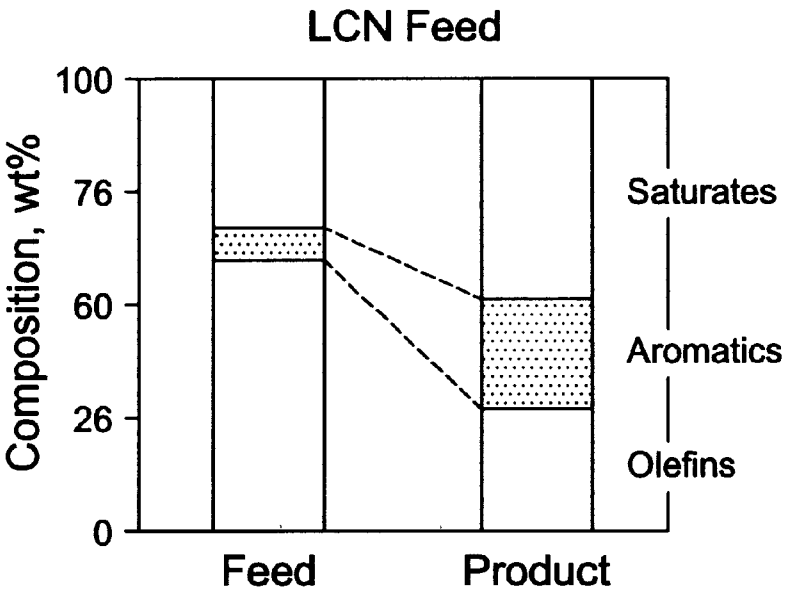
FIG. 1A shows the distribution of species in the product that boil inside the naphtha boiling range.

The invention is based on the discovery that a naphtha feedstream may be catalytically converted to yield a naphtha product having an increased concentration of saturated species, especially isoparaffins, and a diminished concentration of olefins having a molecular weight of about $C_5$ and above. The invention is also based on the discovery that the product has a diminished RVP and an average octane number ((R+M)/2)) that is substantially the same as or greater than the feed's octane number. Beneficially, at least a portion of the sulfur-containing species present in the feed and boiling in the naphtha boiling range are converted into species such as $H_2S$ and coke that boil outside the naphtha boiling range and, consequently, may be separated or otherwise removed from the process.

Suitable feedstreams include those streams boiling in the naphtha range. The feeds may contain from about 5 wt. % to about 35 wt. %, preferably from about 10 wt. % to about 30 wt. %, and more preferably from about 10 to about 25 wt. % paraffins, and from about 15 wt. %, preferably from about 20 wt. % to about 70 wt. % olefins. The feed may also contain naphthenes and aromatics. Naphtha boiling range streams are typically those having a boiling range from about 65° F. to about 430° F., preferably from about 65° F. to about 300° F. The naphtha may be, for example, a thermally cracked or a catalytically cracked naphtha. Such streams may be derived from any appropriate source. For example, they can be derived from the fluid catalytic cracking of gas oils and resids, or they can be derived from delayed or fluid coking of resids. It is preferred that the naphtha streams used in the practice of the present invention be derived from the fluid catalytic cracking of gas oils and resids. Such naphthas are typically rich in olefins and/or diolefins and relatively lean in paraffins. Moreover, such streams may contain sulfur-bearing species in concentrations ranging, for example, from about 200 ppmw to about 5,000 ppmw.

A preferred process is performed in a process unit comprised of a reaction zone, a stripping zone, a catalyst regeneration zone, and a fractionation zone. The naphtha feedstream is fed into the reaction zone where it contacts a source of hot, regenerated catalyst. The hot catalyst vaporizes and cracks the feed at a temperature from about 500° C. to about 650° C., preferably from about 500° C. to about 600° C. The cracking reaction deposits carbonaceous hydrocarbons, or coke, on the catalyst, thereby deactivating the catalyst. The cracked products are separated from the coked catalyst and conducted to a fractionation zone. The coked catalyst is conducted through the stripping zone where volatiles are stripped from the catalyst particles with steam. The stripping can be preformed under low severity conditions in order to retain adsorbed hydrocarbons for heat balance. The stripped catalyst is then conducted to the regeneration zone where it is regenerated by burning coke on the catalyst in the presence of an oxygen containing gas, preferably air. Decoking restores catalyst activity and simultaneously heats the catalyst to a temperature ranging from about 650° C. about 750° C. The hot catalyst is then recycled to the reaction zone to react with fresh naphtha feed. Flue gas formed by burning coke in the regenerator may be treated for removal of particulates and for conversion of carbon monoxide, after which the flue gas is normally discharged into the atmosphere. The cracked products from the reaction zone are conducted to a fractionation zone where various products are recovered, particularly a naphtha fraction, a $C_3$ fraction, and a $C_4$ fraction.

Although the process of the invention may be practiced in the FCC process unit itself, the preferred process uses its own distinct process unit, as previously described, which receives naphtha from a suitable source. The reaction zone is operated at process conditions that will maximize light (i.e., $C_2$ to $C_4$) olefin selectivity, particularly propylene selectivity, with relatively high conversion of $C_5$+olefins. Preferred catalysts include those which contain one or more molecular sieves such as zeolite having an average pore diameter less than about 0.7 nanometers (nm), the molecular sieve comprising from about 10 wt. % to about 50 wt. % of the total fluidized catalyst composition. It is preferred that the molecular sieve be selected from the family of medium pore size (<0.7 nm) crystalline aluminosilicates, otherwise referred to as zeolites. Of particular interest are the medium pore zeolites with a silica to alumina molar ratio of less than about 75:1, preferably less than about 50:1, and more preferably less than about 40:1. The pore diameter also sometimes referred to as effective pore diameter can be measured using standard adsorption techniques and hydrocarbonaceous compounds of known minimum kinetic diameters. See Breck, *Zeolite Molecular Sieves*, 1974 and Anderson et al., J. Catalysis 58, 114 (1979), both of which are incorporated herein by reference.

Preferred molecular sieves include medium pore size zeolites described in "Atlas of Zeolite Structure Types," eds. W. H. Meier and D. H. Olson, Butterworth-Heineman, Third Edition, 1992, which is hereby incorporated by reference. The medium pore size zeolites generally have a pore size from about 0.5 nm, to about 0.7 nm and include for example, MFI, MFS, MEL, MTW, EUO, MTT, HEU, FER, and TON structure type zeolites (IUPAC Commission of Zeolite Nomenclature). Non-limiting examples of such medium pore size zeolites, include ZSM-5, ZSM-12, ZSM-22, ZSM-23, ZSM-34, ZSM-35, ZSM-38, ZSM-48, ZSM-50, silicalite, and silicalite 2. The most preferred is ZSM-5, which is described in U.S. Pat. Nos. 3,702,886 and 3,770,614. ZSM-11 is described in U.S. Pat. No. 3,709,979; ZSM-12 in U.S. Pat. No. 3,832,449; ZSM-21 and ZSM-38 in U.S. Pat. No. 3,948,758; ZSM-23 in U.S. Pat. No. 4,076,842; and ZSM-35 in U.S. Pat. No. 4,016,245. All of the above patents are incorporated herein by reference. Other suitable medium pore size molecular sieves include the silicoaluminophosphates (SAPO), such as SAPO-4 and SAPO-11 which is described in U.S. Pat. No. 4,440,871; chromosilicates; gallium silicates; iron silicates; aluminum phosphates (ALPO), such as ALPO-11 described in U.S. Pat. No. 4,310,440; titanium aluminosilicates (TASO), such as TASO-45 described in EP-A No. 229,295; boron silicates, described in U.S. Pat. No. 4,254,297; titanium aluminophosphates (TAPO), such as TAPO-11 described in U.S. Pat. No. 4,500,651; and iron aluminosilicates.

The medium pore size zeolites may include "crystalline admixtures" which are thought to be the result of faults occurring within the crystal or crystalline area during the synthesis of the zeolites. Examples of crystalline admixtures of ZSM-5 and ZSM-11are disclosed in U.S. Pat. No. 4,229,424 which is incorporated herein by reference. The crystalline admixtures are themselves medium pore size zeolites and are not to be confused with physical admixtures of zeolites in which distinct crystals of crystallites of different zeolites are physically present in the same catalyst composite or hydrothermal reaction mixtures.

The catalysts of the present invention may be bound together with an inorganic oxide matrix component. The inorganic oxide matrix component binds the catalyst components together so that the catalyst product is hard enough to survive interparticle and reactor wall collisions. The inorganic oxide matrix can be made from an inorganic oxide sol or gel which is dried to "glue" the catalyst components together. Preferably, the inorganic oxide matrix is not catalytically active and will be comprised of oxides of silicon and aluminum. It is also preferred that separate alumina phases be incorporated into the inorganic oxide matrix. Species of aluminum oxyhydroxides-γ-alumina, boehmite, diaspore, and transitional aluminas such as α-alumina, β-alumina, γ-alumina, β-alumina, ε-alumina, k-alumina, and ρ-alumina can be employed. Preferably, the alumina species is an aluminum trihydroxide such as gibbsite, bayerite, nordstrandite, or doyelite. The matrix material may also contain phosphorous or aluminum phosphate.

The preferred cracking catalysts do not require steam contacting, treatment, activation, and the like to develop olefin conversion selectivity, activity, or combinations thereof. Preferred catalysts include OLEFINS MAX ™ catalyst available from W. R. Grace and Co., Columbia, Md.

As discussed, the preferred molecular sieve catalyst does not require steam activation for use under olefin conversion conditions to selectively form light olefins from a catalytically or thermally cracked naphtha containing paraffins and olefins. In other words, the preferred process propylene yield is substantially insensitive to whether the preferred molecular sieve catalysts contact steam prior to catalytic conversion, during catalytic conversion, or some combination thereof However, steam does not detrimentally affect such a catalyst, and steam may be present in the preferred olefin conversion process.

Steam may be and frequently is present in fluidized bed reactor processes in the feed and in regions such as the reactor zone and the regenerator zone. The steam may be added to the process for purposes such as stripping and it may naturally evolve from the process during, for example, catalyst regeneration. In a preferred embodiment, steam is present in the reaction zone. Importantly, the presence of steam in the preferred process does not affect catalyst activity or selectivity for converting feeds to light olefins to the extent observed for naphtha cracking catalysts known in the art. For the preferred catalysts, propylene yield by weight based on the weight of the naphtha feed under the preferred process conditions ("propylene yield") does not strongly depend on catalyst steam pretreatment or the presence of steam in the process. Accordingly, at least about 60 wt. % of the $C_5$+olefins in the naphtha stream are converted to $C_4$−products and the reactor effluent's total $C_3$ product comprises at least about 90 mol. % propylene, preferably greater than about 95 mol. % propylene, whether or not (i) catalyst steam pretreatment is employed, (ii) steam is added to or evolves in the catalytic conversion process, or (iii) some combination of (i) and (ii) is employed.

Conventional molecular sieve catalyst steam activation procedures involving steam pretreatment and adding steam to a feed are set forth, for example, in U.S. Pat. No. 5,171,921. Conventionally, a steam pretreatment may employ 1 to 5 atmospheres of steam for 1 to 48 hours. When steam is added in conventional processes, it may be present in amounts ranging from about 1 mol. % to about 50 mol. % of the amount of hydrocarbon feed. Pretreatment is optional in the preferred process because the preferred catalyst's activity and selectivity for propylene yield is substantially insensitive to the presence of steam.

When a pretreatment is employed in the preferred process, it may be conducted with 0 to about 5 atmospheres of steam. By 0 atmospheres of steam it is meant that no steam is added in the pretreatment step. Steam resulting from, for example, water desorbed from the catalyst, associated pretreatment equipment, and combinations thereof may be present, usually in very small amounts, during pretreatment even when no steam is added. However, like added steam, this steam does not substantially affect the catalyst's activity for propylene yield. Adding steam to the preferred process as in, for example, stripping steam, a naphtha-steam feed mixture, or some combination thereof is also optional. When steam is added to the preferred process, it may be added in an amount ranging from about 0 mol. % to about 50 mol. % of the amount of hydrocarbon feed. As in the case of pretreatment, 0 mol. % steam means that no steam is added to the preferred process. Steam resulting from the preferred process itself may be present. For example, steam resulting from catalyst regeneration may be present, usually in very small amounts, during the preferred process even when no steam is added. However, such steam does not substantially affect the catalyst's activity for propylene yield.

When the preferred catalysts of this invention are steam pretreated and then employed in the preferred process, propylene yield changes by less than 40%, preferably less than 20%, and more preferably by less than 10% based on the propylene yield of the preferred process using an identical catalyst that was not pretreated. Similarly, when the preferred catalyst is used in the preferred process and steam is injected with the naphtha, propylene yield changes by less than 40%, preferably less than 20%, and more preferably by less than 10% based on the propylene yield of the preferred process using an identical catalyst where steam injection was not employed. Preferably, propylene yield ranges from about 8 wt. % to about 30 wt. %, based on the weight of the naphtha feed.

The Steam Activation Index test is one way to evaluate catalysts to determine whether they would require steam activation for use in naphtha cracking. In accordance with the test:

(i) a candidate catalyst is calcined at a temperature of 1000° F. for four hours and then divided into two portions;

(ii) 9 grams of the first catalyst portion are contacted with hydrocarbon consisting of a catalytically cracked naphtha boiling in the range of $C_5$ to 250° F. and containing 35 wt. % to 50 wt. % olefins based on the weight of the naphtha in order to form a product containing propylene (The contacting is conducted in a model "R" ACE ™ unit available from Xytel Corp Elk Grove Village, Ill. The contacting in the ACE unit is conducted under catalytic conversion conditions that include a reactor temperature of 575° C., a reactor pressure differential of 0.5 psi to 1.5 psi, a feed injection time of 50 seconds and a feed injection rate of 1.2 grams per minute.) and the amount of propylene in the product is determined;

(iii) the second catalyst portion is exposed to 1 atmosphere of steam at a temperature of 1500° F. for 16 hours; and then (iv) 9 grams of the catalyst from (iii) is contacted with the same naphtha as in (ii) in the ACE unit under the same conditions as in (ii) and the amount of propylene in the product is determined; and (v) the ratio of the wt. % yield of the propylene in (ii) to the wt. % yield of the propylene in (iv) is the Steam Activation Index.

For the preferred catalysts, the Steam Activation Index is above 0.75. More preferably, such catalysts have a Steam Activation index ranging from 0.75 to about 1, and still more preferably ranging from about 0.8 to about 1, and even more preferably from 0.9 to about 1.

Preferred process conditions include temperatures from about 500° C. to about 650° C., preferably from about 525° C. to about 600° C., hydrocarbon partial pressures from about 10 to 40 psia, preferably from about 20 to 35 psia; and a catalyst to naphtha (wt/wt) ratio from about 3 to 12, preferably from about 4 to 10, where the catalyst weight is the total weight of the catalyst composite. While not required, it is also preferred that steam be concurrently introduced with the naphtha stream into the reaction zone, with the steam comprising up to about 50 wt. % of the hydrocarbon feed. Also, it is preferred that the naphtha residence time in the reaction zone be less than about 10 seconds, for example from about 1 to 10 seconds. The above conditions will be such that at least about 60 wt. % of the $C_5$+ olefins in the naphtha stream are converted to $C_4$−products and less than about 25 wt. %, preferably less than about 20 wt. % of the paraffins are converted to $C_4$−products, and that propylene comprises at least about 90 mol. %, preferably greater than about 95 mol. % of the total $C_3$ reaction products with the weight ratio of propylene/total $C_2$−products greater than about 3.5. It is also preferred that ethylene comprises at least about 90 mol. % of the $C_2$ products, with the weight ratio of propylene:ethylene being greater than about 4, and that the "full range" $C_5$+naphtha product is substantially maintained or enhanced in both motor and research octanes relative to the naphtha feed. The preferred conditions will also result in a naphtha product Reid Vapor Pressure of about 1 psi less than the Reid Vapor Pressure of the feed. The invention is compatible with catalyst precoking prior to introduction of feed to adjust process parameters such as propylene selectivity. It is also within the scope of this invention that an effective amount of single ring aromatics be fed to the reaction zone to also improve the selectivity of propylene vs. ethylene.

The preferred process may be used to provide a naphtha product that may be used for blending motor gasolines. In this regard, an important feature of the preferred process relates to the process' ability to remove feed sulfur species by converting them to species such as $H_2S$ and coke that boil outside the naphtha boiling range. Table 1 illustrates this aspect of the invention.

TABLE 1

| | Feed Naphtha | Product Naphtha (40% Conversion) |
|---|---|---|
| Olefin Content | 42.5 wt. % | 16.9 wt. % |
| Aromatics Content | 13.1 wt. % | |
| Average B.P. | 185° F. | |
| 90 wt. % B.P. | 282° F. | |
| API Gravity | 68.3 | |
| RON (Engine) | 91.1 | 91 |
| MON (Engine) | 78.6 | 78.9 |
| Sulfur wppm | 185 ppm | 210 ppm |

The data in Table 1 were obtained with a 25 wt. % ZSM-5 catalyst having a 40:1 silica to alumina molar ratio. The reactor temperature was 590° C., the oil residence time was 4 seconds, the catalyst to naphtha ratio was about 10, and the naphtha partial pressure was 1.2 atmospheres. Although the product's sulfur concentration slightly exceeds that of the feed's, overall sulfur is removed from the naphtha boiling range. For example, $10^6$ pounds of the feed would contain 185 pounds of sulfur. The product would contain 600,000 pounds of naphtha (40% conversion), but would only contain 126 pounds of sulfur, the remaining 59 pounds having been converted to sulfur species boiling outside the naphtha boiling range.

EXAMPLES

Example 1

Naphtha Olefin and Sulfur Conversion

Representative naphthas having average boiling points ranging from about 150° F. to about 350° F., corresponding to light, intermediate, and heavy naphtha, and mixtures thereof, were used as feeds to test the invention's effectiveness for producing naphtha with low sulfur and low olefin concentration. The feeds used in these examples are set forth in Table 2.

TABLE 2

| Sample | Olefins wt % | Aromatics wt % | Avg BP deg F. | 90 wt % deg F. | API Gravity | RON/MON |
|---|---|---|---|---|---|---|
| A | 61.8 | 7.8 | 175 | 254 | 69.1 | 93.3/78.0 |
| B | 50.9 | 7.4 | 175 | 255 | 69.4 | 92.3/79.1 |
| C | 53.1 | 5.6 | 167 | 245 | 73.5 | 93.7/78.5 |
| D | 47.8 | 6.7 | 164 | 242 | 74.5 | 92.4/78.3 |
| E | 42.5 | 13.1 | 185 | 282 | 68.3 | 91.1/78.6 |
| F | 39.1 | 16.5 | 198 | 289 | 65.1 | 91.2/78.2 |
| G | 38.9 | 24.1 | 229 | 343 | 58.7 | 91.4/79.4 |
| H | 32.5 | 21.7 | 198 | 298 | 56.5 | 92.0/80.0 |
| I | 30.1 | 30.1 | 242 | 372 | 56.4 | 89.5/78.4 |
| J | 26.1 | 29.7 | 250 | 304 | 52.8 | 88.5/78.2 |
| K | 11.0 | 58.8 | 347 | 405 | 38.2 | 91.2/80.1 |
| L | 36.0 | 25.6 | 264 | 421 | 5306 | 84.2/71.3 |

Average Boiling Point = (10% + 2*(50%) + 90%)/4
RON and MON by engine test

Histograms showing feed species distribution for a light catalytically cracked naphtha ("LCN") (sample B) and a full range naphtha (sample H) are shown in FIG. 1A.

A portion of sample B was catalytically converted with an Olefins Max catalyst in accord with the invention at a reactor temperature of about 1100° F. Process conditions included a catalyst:naphtha ratio of about 8, a naphtha residence time of about 4 seconds. Likewise, a portion of Sample H was catalytically converted under similar conditions.

For both samples, approximately 40 wt. % of feed and in particular about 80 wt. % of the olefin in the feed are converted into products having boiling points outside the naphtha boiling range. The distribution of the product's species boiling inside the naphtha boiling range is also shown in FIG. 1-A.

Figures 1, 1A, 2:
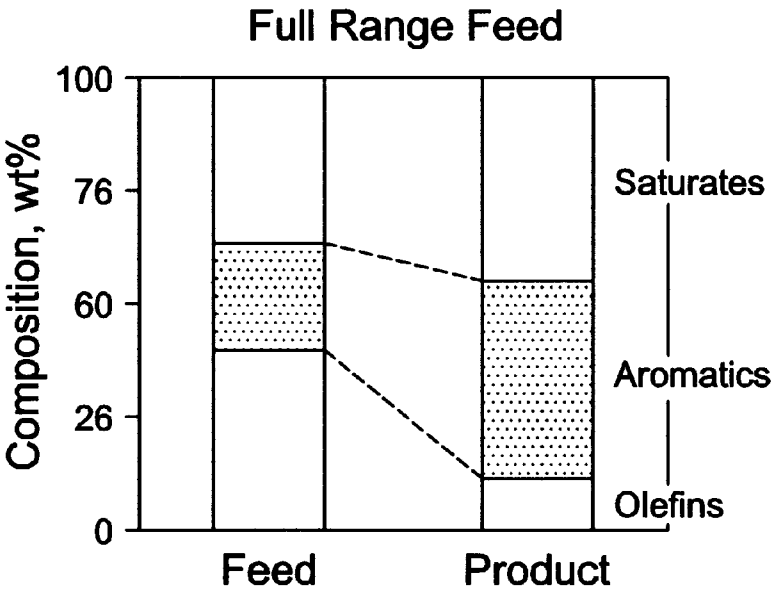
FIG. 2 shows the concentration of desirable isoparaffin species in the product.
Figure 1B:
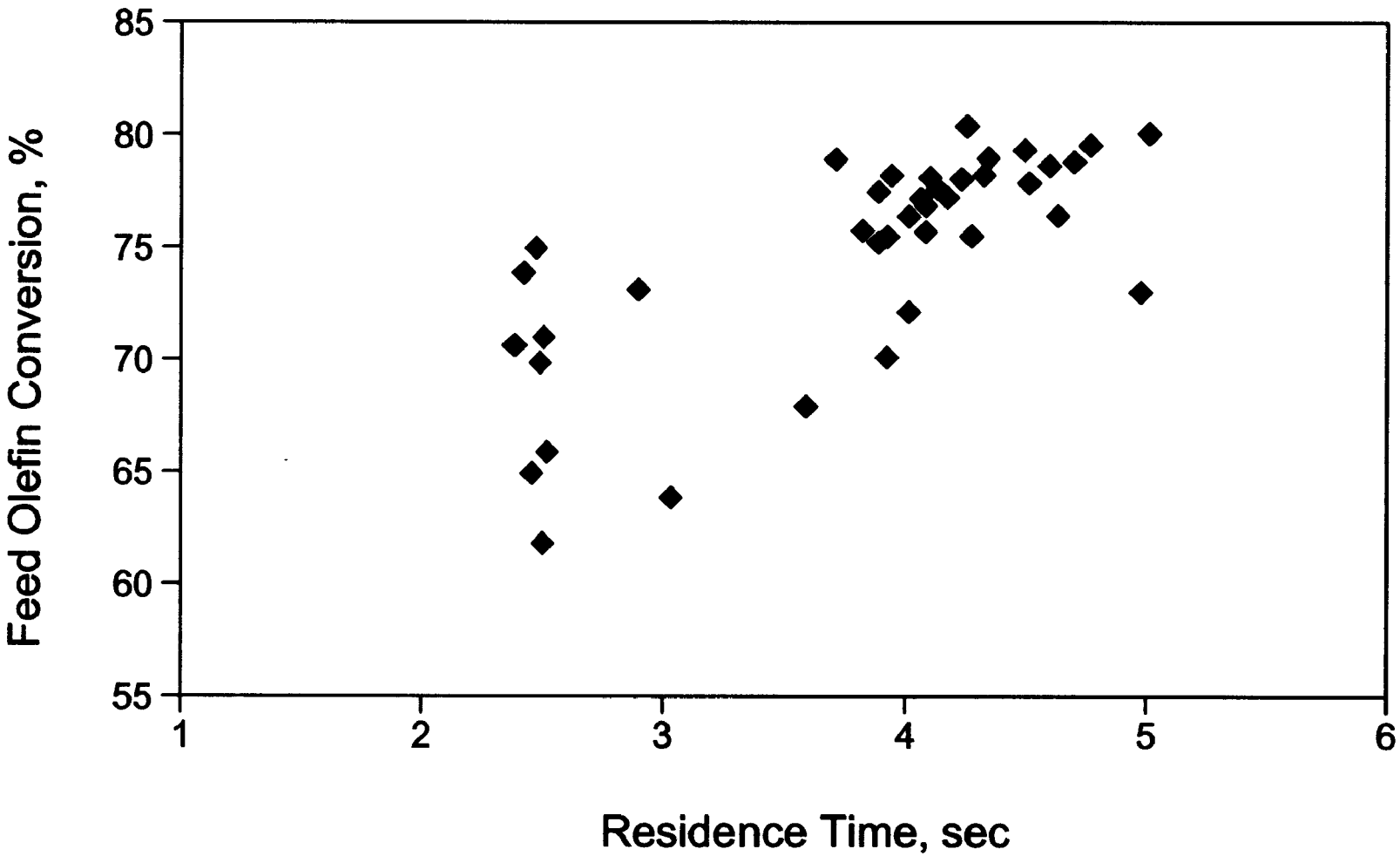
FIG. 1B Shows feed olefin conversion variation with catalyst residence time.
Figure 2:
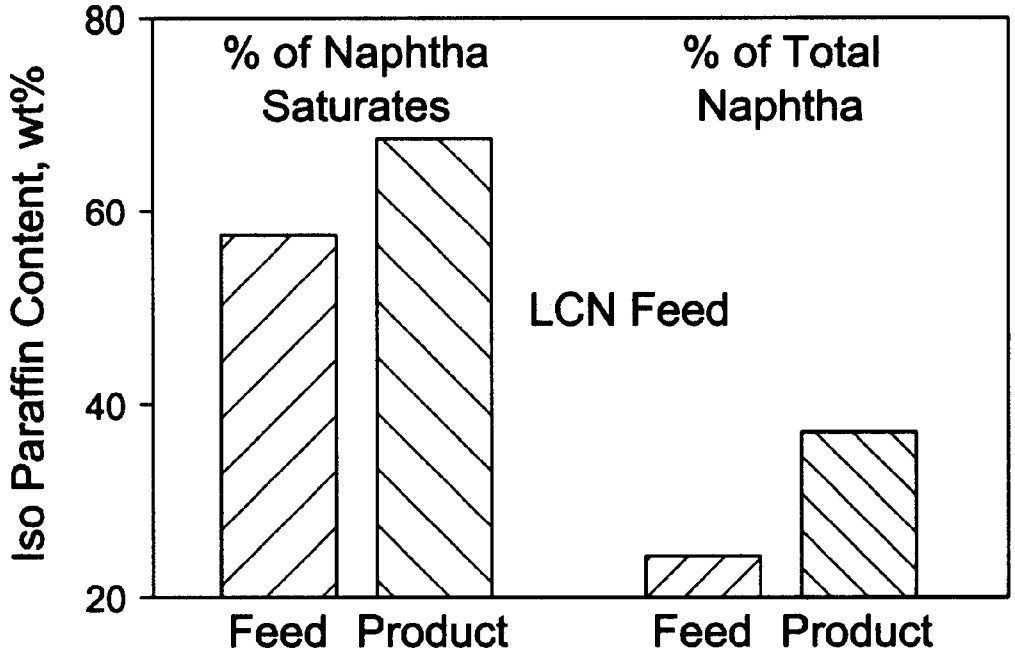

FIG. 1-B shows the variation of olefin conversion with catalyst residence time for all the samples in Table 2. The data for FIG. 1B were obtained with an Olefins Max catalyst (25% ZSM-5) with an oil residence time of about 4 seconds, a catalyst to naphtha ratio in the range of 4 to 15, and a reactor temperature in the range of 565° C. to 604° C. As can be seen, the feed olefin cracking resulted in a naphtha product relatively richer in aromatic and saturated species. Moreover, the concentration of desirable isoparaffin species in the product increases both as a percentage of naphtha saturates and as a percentage of total naphtha, as is shown in the histogram of FIG. 2 for sample B under the same conditions as in FIG. 1A.

Figure 3:
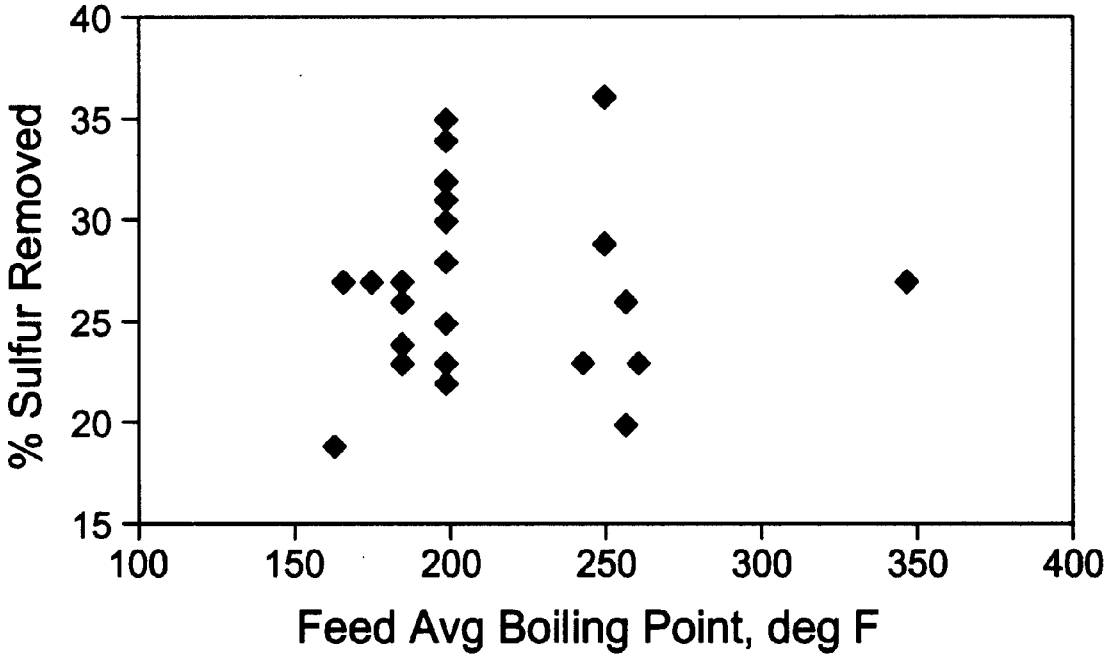
FIG. 3 shows that the preferred process results in removing sulfur from the naphtha feed.

The invention also was tested for feed sulfur removal and product octane augmentation effectiveness with the representative feed naphthas of Table 2 under conditions similar to those set forth above in the feed olefin conversion tests, but with a reactor temperature of 595° C., an oil residence time in the range of 4.5–6.5 seconds, and a catalyst to naphtha ratio in the range of 9.5 to 10.5. As can be seen in FIG. 3, 25 wt. % to about 40 wt. %, based on the total weight of sulfur in the feed, is converted to species boiling outside the naphtha boiling range for the range of naphthas employed.

Figure 4:
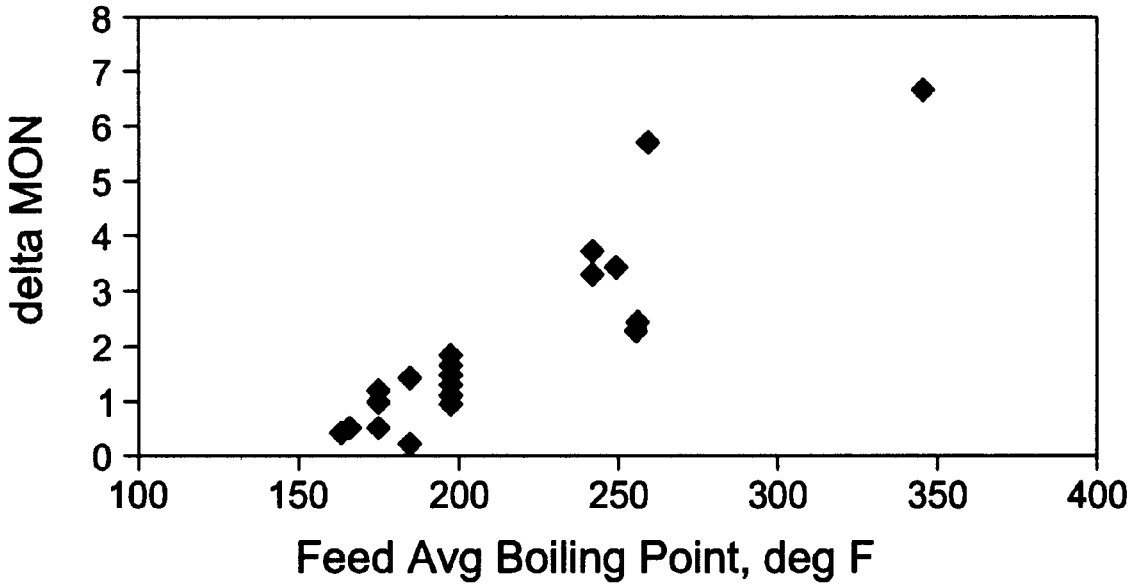
FIG. 4 shows the difference between product and the feed's Motor Octane Number (engine) as a function of feed average boiling point.
Figure 5:
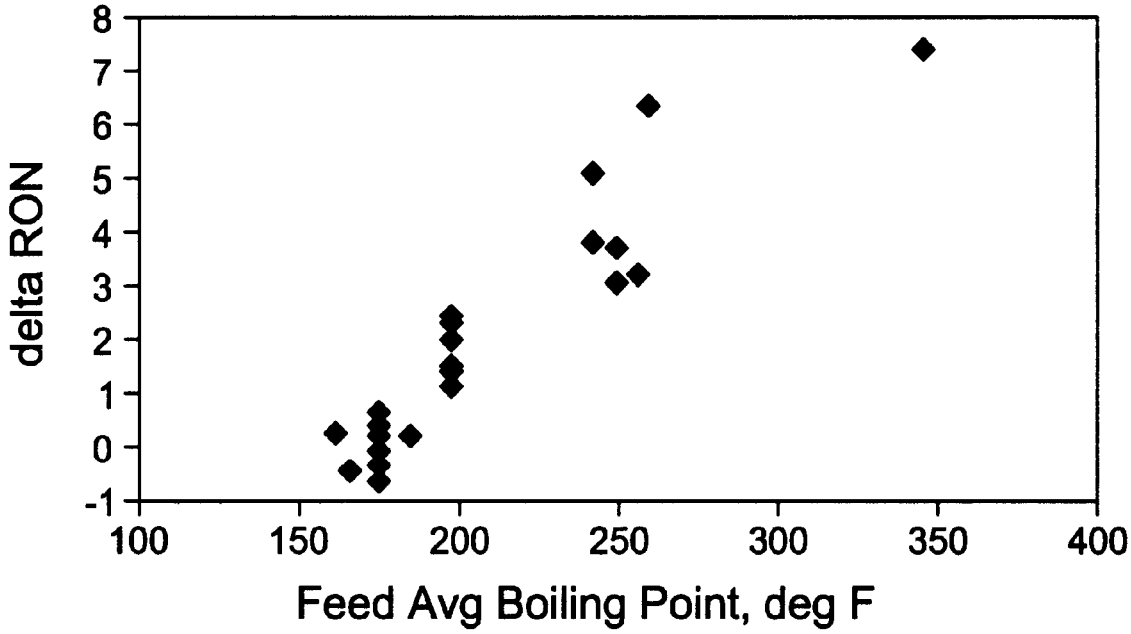
FIG. 5 shows the difference between product and the feed's Research Octane Number (engine) as a function of feed average boiling point.

The results of octane enhancement tests are summarized in FIGS. 4 and 5. The tests were conducted under conditions similar to those used in the sulfur removal tests and used the same feeds. As shown in FIG. 4, the naphtha product's Motor Octane is higher than the feed's over the whole naphtha boiling range, with the largest increase being observed for the heaviest naphtha. FIG. 5 shows that a small reduction in Research Octane is obtained for the lightest naphthas studied, with an improvement shown for progressively heavier feeds. It should be noted that average product octane (R+M)/2 is substantially the same or increases for all naphtha feeds employed, the reduction in Research Octane for light feeds being compensated by the increase in Motor Octane.

Example 2

Product Composition Analysis

Figure 6:
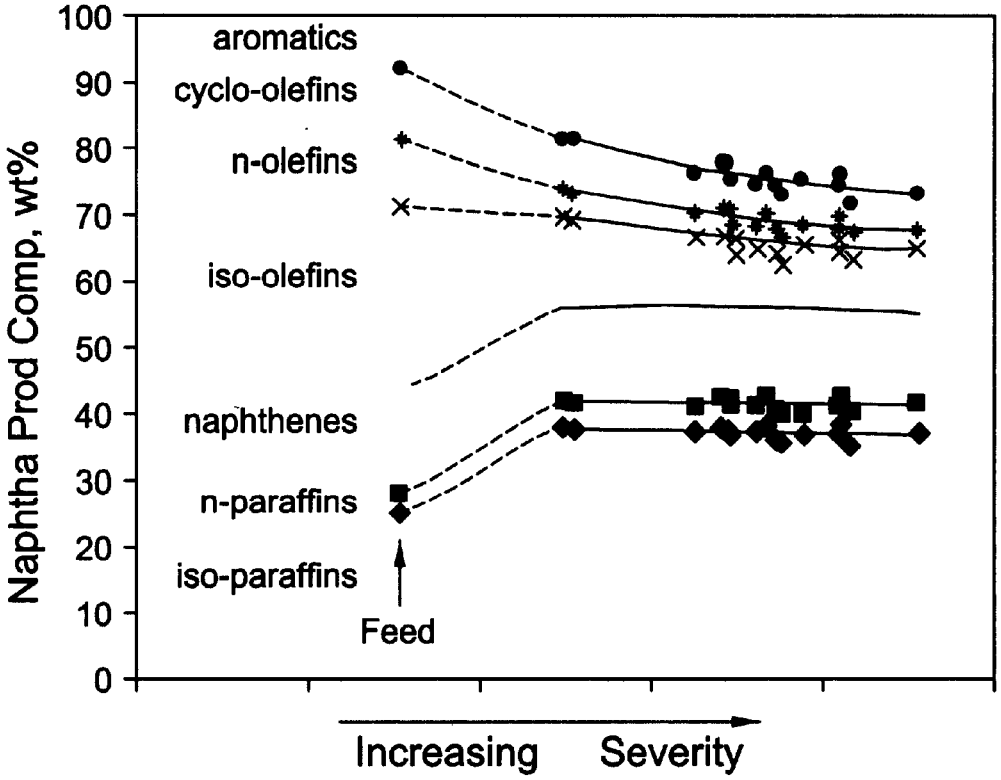
FIG. 6 shows for the preferred process the distribution of hydrocarbon species in the feed and the change in product hydrocarbon species distribution with increasing process severity.

A portion of sample B from Table 2 was analyzed compositionally as shown in FIG. 6. As can be seen, the sum of the species' weight percents adds to 100 wt. %. The sample was then converted in accordance with the preferred process at a reactor temperature of 595° C. with an Olefins Max catalyst and a 4 second oil residence time. Catalytic conversion conditions were made increasingly more severe by changing a reactor temperature in the range of 565° C. to 604° C., the catalyst to naphtha ratio in the range of 4 to 15, and the oil residence time in the range of 2 to 5. The naphtha product from feed conversion was then analyzed compositionally and plotted, also on FIG. 6. The figure shows that a dramatic change in naphtha composition occurs even when the process of the invention is conducted at low severity.

Example 3

Comparison with a Conventional Process

By way of comparison, naphtha present in the feed riser that was cracked from an FCC unit's primary heavy oil feed was converted in the presence of varying amounts of a ZSM-5 additive catalyst in accord with a conventional process.

Figure 7:
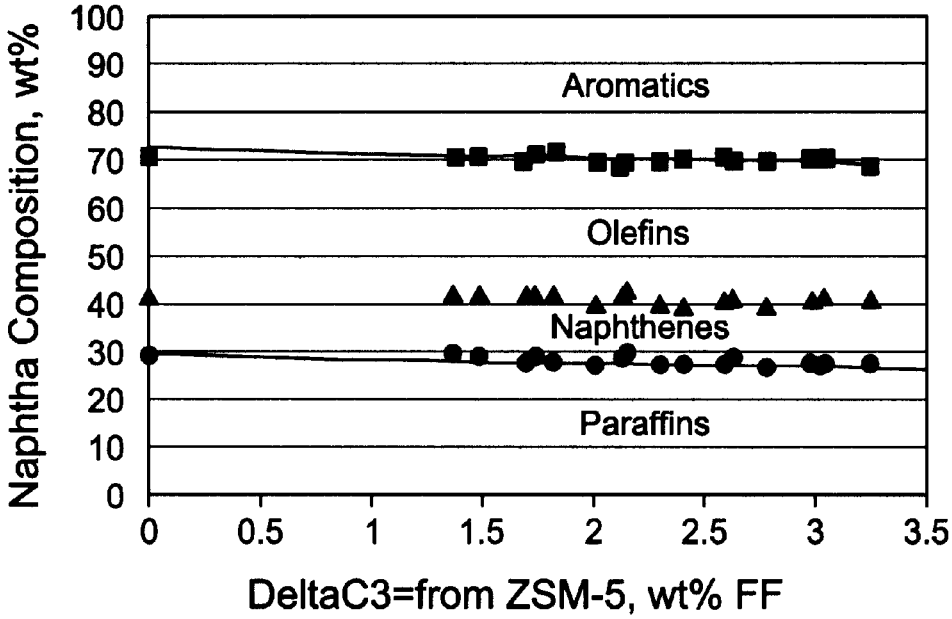
FIG. 7 shows for a conventional process the distribution of hydrocarbon species in the feed and the change in product hydrocarbon species distribution as a function of increased ZSM-5 concentration in the reaction zone.

FIG. 7 shows the compositional analysis of the naphtha in the riser as ZSM-5 is added. As is known, propylene production for a quantity of feed may be used as a measure of the amount of ZSM-5 in the riser. The figure shows that little, if any, olefin cracking occurs as the amount of ZSM-5 in the riser increases. Consequently, the desirable increase in light olefin and isoparaffin concentration that is observed in the preferred process does to accrue in the conventional process.

What is claimed is:

1. A process for forming a high octane naphtha comprising: contacting a naphtha feed having a feed RVP, and a boiling range from about 65° F. to about 450° F., and an average feed octane number and containing paraffinic species and olefinic species under catalytic conversion conditions with a catalytically effective amount of a catalyst containing above 10 to 80 wt. % of a crystalline zeolite having an average pore diameter less than about 0.7 nm at a temperature ranging from about 500° C. to about 650° C., a hydrocarbon partial pressure ranging from about 10 to about 40 psia, a hydrocarbon residence time ranging from about 1 to about 10 seconds, and a catalyst to feed weight ratio ranging from about 2 to about 10 in order to form the high octane naphtha having a product RVP substantially the same as or less than the feed RVP and wherein the resulting product contains from about 60 wt. % to about 90 wt. % less olefin than the naphtha feed.

2. The process of claim 1 wherein less than about 20 wt. % of the feed paraffinic species are converted to species in the high octane naphtha having molecular weights lower than about $C_4$.

3. The process of claim 2 wherein the high octane naphtha has an average octane number substantially the same or greater than the feed average octane number.

4. The process of claim 3 wherein the product RVP is at least about 1 psi less than the feed RVP.

5. The process of claim 4 further comprising combining at least a portion of the high octane naphtha with a composition boiling in the gasoline boiling range and having an initial composition RVP and an initial composition average octane number in order to form a blend having an average blend octane number substantially the same as or greater than the initial average octane number, and an average blend RVP substantially the same as or less than the initial RVP.

6. The process of claim 1 wherein said temperature ranges from about 565° C. to about 650° C.

7. The process of claim 1 wherein said zeolite is selected from the group consisting of MFI, MFS, MEL, MTW, EUO, MTT, HEU, FER, and TON structure zeolites.

8. The process of claim 1 wherein said zeolite is selected from the group consisting of ZSM-5, ZSM-12, ZSM-22, ZSM-23, ZSM-34, ZSM-35, ZSM-38, ZSM-48 and ZSM-50.

9. The process of claim 1 wherein said zeolite is ZSM-5.

10. The process of claim 1 wherein said catalyst contains above 10 to 50 wt. % of a crystalline zeolite having an average pore diameter less than about 0.7 nm.

11. The process of claim 1 wherein said catalyst contains 25 to 80 wt. % of a crystalline zeolite having an average pore diameter less than about 0.7 nm.

12. The process of claim 1 wherein said catalyst contains 25 to 50 wt. % of a crystalline zeolite having an average pore diameter less than about 0.7 nm.

* * * * *